US005795393A

United States Patent [19]

Isfort

[11] Patent Number: 5,795,393

[45] Date of Patent: Aug. 18, 1998

[54] APPARATUS FOR LIMITING THE COATING EDGE IN A SHORT DWELL COATER

[75] Inventor: Wolfgang Isfort, Hemer, Germany

[73] Assignee: Stora Feldmühle AG, Düsseldorf, Germany

[21] Appl. No.: 765,571

[22] PCT Filed: Jul. 8, 1995

[86] PCT No.: PCT/EP95/02673

§ 371 Date: Jan. 13, 1997

§ 102(e) Date: Jan. 13, 1997

[87] PCT Pub. No.: WO96/02703

PCT Pub. Date: Feb. 1, 1996

[30] Foreign Application Priority Data

Jul. 15, 1994 [DE] Germany ..... 44 25 137.8

[51] Int. Cl.[6] ..... B05C 3/02

[52] U.S. Cl. ..... 118/413; 118/410

[58] Field of Search ..... 118/410, 413, 118/261, 407, 419; 427/288, 256, 356; 101/364, 169, 363

[56] References Cited

U.S. PATENT DOCUMENTS 4,250,211 2/1981 Damrau et al. .

4,434,194 2/1984 Gebert et al. ..... 118/410

FOREIGN PATENT DOCUMENTS 319503 6/1989 European Pat. Off. .

3815764 11/1988 Germany .

2204255 4/1988 United Kingdom .

*Primary Examiner*—Brenda A. Lamb

*Attorney, Agent, or Firm*—Cohen, Pontani, Lieberman, Pavane

[57] ABSTRACT

A coating edge limiter for a coating arrangement with a short dwell time. Color is fed under pressure into a coating chamber formed by a backing roll around which a paper web is guided, a barrier wall, a doctor blade element and sealing blocks located at both ends of the coater. A formatting plate almost completely covers an application zone between the doctor blade element and the barrier wall so that an edge region of the web is sharply delineated and kept completely free of color. In each of the sealing blocks water is supplied via channels to depressions thereby forming a pressure cushion. This pressure cushion prevents the pressurized color in the coating chamber from flowing out laterally and ensures that the formatting plate is pressed flatly against the web. The coating edge limiter thereby makes it possible to establish very precisely the width of the web to be produced.

5 Claims, 2 Drawing Sheets

APPARATUS FOR LIMITING THE COATING EDGE IN A SHORT DWELL COATER

FIELD OF THE INVENTION

The invention relates to a coating edge limiter for a coating arrangement with a short dwell time.

BACKGROUND OF THE INVENTION

A short dwell coater is disclosed in U.S. Pat. No. 4,250,211. Coating edge limiters of the aforementioned type are known and used mainly as sealing elements at both roll ends in order to prevent coating color from flowing laterally out of a coating chamber.

An end seal for a coating arrangement with a short dwell time is described in German Patent publication 38 15 764 A1. An upper outer surface of the end seal facing the paper web has openings through which water is introduced between the outer surface and the paper web for the purpose of improving tightness and reducing wear on the end seal. A disadvantage of this design is that the coating color diluted by the introduced water leaves behind less coating on the edges of the paper web thereby creating a transitional area in which the coating weight declines. A trimming edge of corresponding width must then be cut off because the machine operator cannot determine visually the exact point up to which the paper web has the required coating weight. Furthermore, the water supply causes the dry web edges to become moist. This leads to waviness at the web edges, particularly in the case of lightweight paper webs. The running qualities of the web deteriorate to the point that the web tears. Using this known end seal, it is not possible to obtain a clean edge free of coating color.

SUMMARY OF THE INVENTION

The object of the present invention is to create coating edge limiters capable of attaining sharply delineated web edges completely free of coating color while avoiding contamination with encrusted color.

This object is attained with the present inventive coating edge limiter for a coating arrangement with a short dwell time, including a mating roll with a circumferential surface that carries a material web, especially a paper web. A doctor blade element extends over the entire width of the material web and is used to apply the coating. An application zone is formed between the doctor blade element and a barrier wall oriented parallel to the doctor blade element. Two coating edge limiters, each with a sealing block and a sliding element, are arranged in an edge region movable at a right angle to the web direction. A formatting plate holder is connected permanently to the sealing block and extends outwardly over the barrier wall. On the formatting plate holder a thin formatting plate is arranged in such a way as to extend from the outside over the barrier wall into the space between the barrier wall and the doctor blade element in order to completely cover the application zone in the edge region of the material web. The sealing block, on the side facing the formatting plate, has at least one depression, that extends parallel to the direction of web movement and is connected to a water supply by a channel. A narrow sealing gap, from 1 to 3 mm wide, is formed between the formatting plate and the sealing block. Water introduced into the sealing gap through the depression produces a pressure cushion and presses the formatting plate flatly against the material web. The formatting plate holder, preferably formed of spring steel, has a thickness greater than or equal to 0.4 mm and is attached to the formatting plate holder by some type of clamping means. Furthermore, the formatting plate, at a right angle to the direction of web movement, is of a width that overlaps the width of the sealing block by approximately 5% to 20%. Preferably, the sealing block is formed of a metal material. A water spraying device is located at the free end of the formatting plate holder. The water spraying device has a needle nozzle through which a fine jet of water is sprayed onto the formatting plate.

The formatting plate permanently connected to the coating edge limiter completely covers the application zone in the edge area of the web. The continuous supply of water in the sealing nip between the formatting plate and the sealing block creates a pressure cushion. This pressure cushion prevents the pressurized color in the coating chamber from flowing out laterally and also keeps the formatting plate pressed flatly against the web. As a result, no coating color can tie applied to the web where the web is covered by the formatting plate. In this way, a sharp delineation is achieved between the coated material and the edge strips to be trimmed. In other words, in accordance with the coating edge limiter of the present invention it is possible to establish very precisely the width of the web to be produced.

The formatting plate, preferably made of spring steel having a thickness of a few tenths of a millimeter, preferably less than or equal to 0.4 mm, adapts well to the curved contour of the backing roll. The application zone is thus covered until directly in front of the doctor blade element. In contrast, the sealing block, which is advantageously overlapped by the formatting plate by 5% to 20%, has a simple contour that does not need to be exactly adapted to a more or less curved doctor blade element. The emergence of color is prevented, as already described, by the pressure cushion which forms as the supplied water builds up in the sealing nip. Because the surface of the formatting plate remains at rest, in contrast to the moving material surface, the flow speed of the color declines sharply there. The color mixes with the supplied water to only a slight extent. Moveover, the continuous outward flow of water from the sealing nip prevents disruptive deposits of coating, to thereby keep the coating edge limiter clean.

In an embodiment of the invention, the sealing block is made of metal, particularly rust-free steel. Because of the good heat conductivity of metals, condensation water forms on the surface of the sealing block, which remains relatively cold due to the continuous flow of cold water. For this reason, no color deposits can accumulate there. In previously known plastic and rubber seals, the area of the doctor blade element is particularly subject to color deposits because it is not possible for the seal or sealing block to rest completely on the doctor blade element for different pressure forces leading to different curvatures of the doctor blade element.

In another embodiment of the invention, a water spraying device moistens the surface of the formatting plate facing the web with a fine jet of water, in order, particularly in the case of abrasive base papers, to lubricate the surfaces that rub together and thus minimize wear on the formatting plate. Tests have shown that the quantity of water needed for this purpose is so small that no negative effects are found on the web edge. In this way, the serviceable life of the formatting plate can be extended from hours to up to several weeks. The formatting plate can be exchanged quickly using a clamping device, without requiring any special adjustments to the coating edge limiter.

DETAILED DESCRIPTION OF THE PRESENTLY PREFERRED EMBODIMENTS

Figure 1:
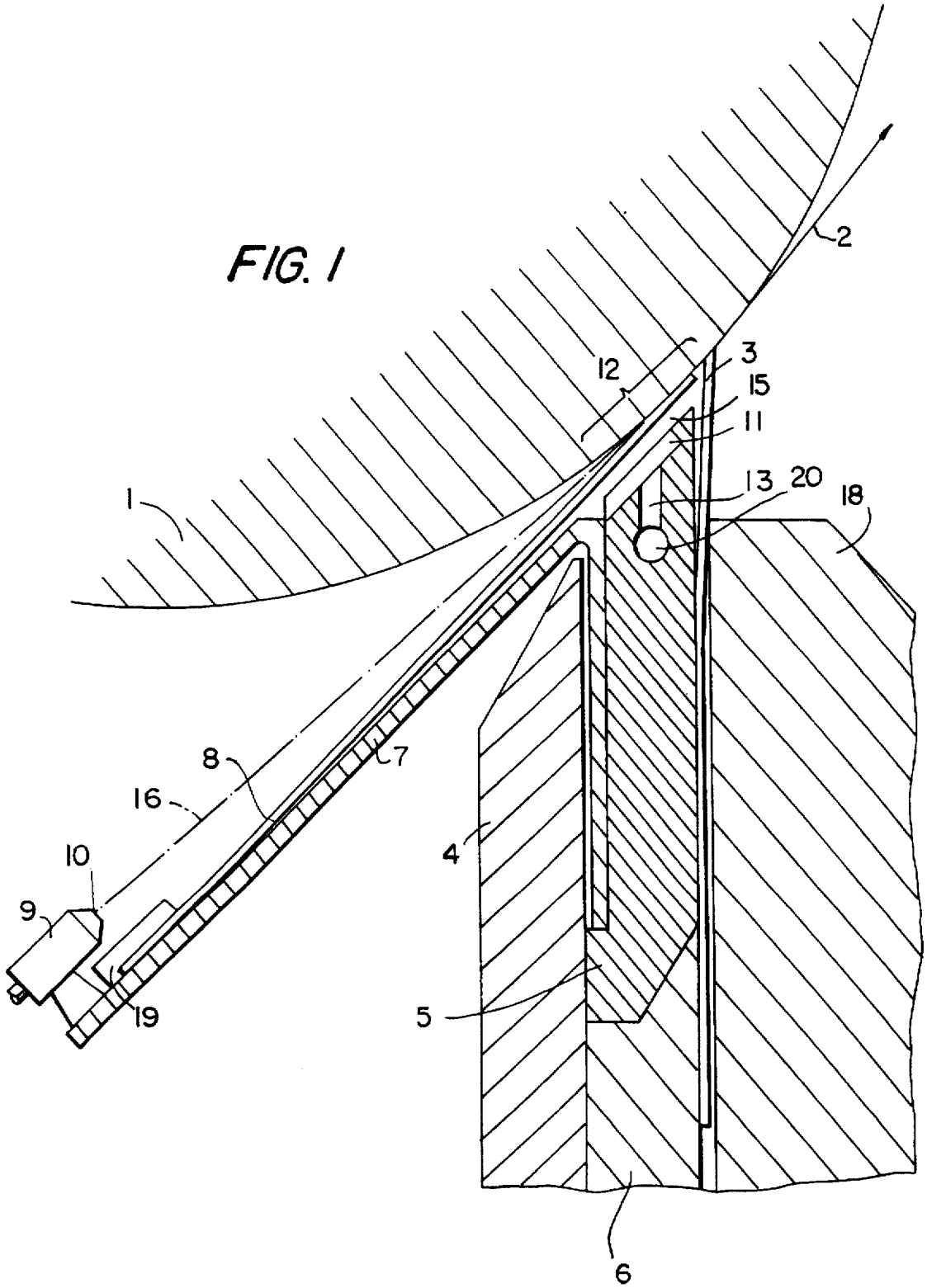
FIG. 1 shows a cross-sectional view, limited to the region essential to the invention, of the coating edge limiter according to the present invention in a coating arrangement.

Details of a coating arrangement are known and described in U.S. Pat. No. 4,250,211. For this reason, only those parts of such a coater that relate to the invention are described below.

A backing roll 1 around which a web 2 is guided, a barrier wall 4, a doctor blade element 3, and sealing blocks 5 located at both ends of the coating arrangement form a coating chamber (not described in greater detail) into which color is fed under pressure. The doctor blade element 3 extends over the entire width of the web and rests against a part 18. The application weight of the coating color is on the order of 5 to 16 g/m$^2$ and is substantially determined by the pressure force of the doctor blade element 3. Excess color is guided away via the barrier wall 4.

Figure 2:
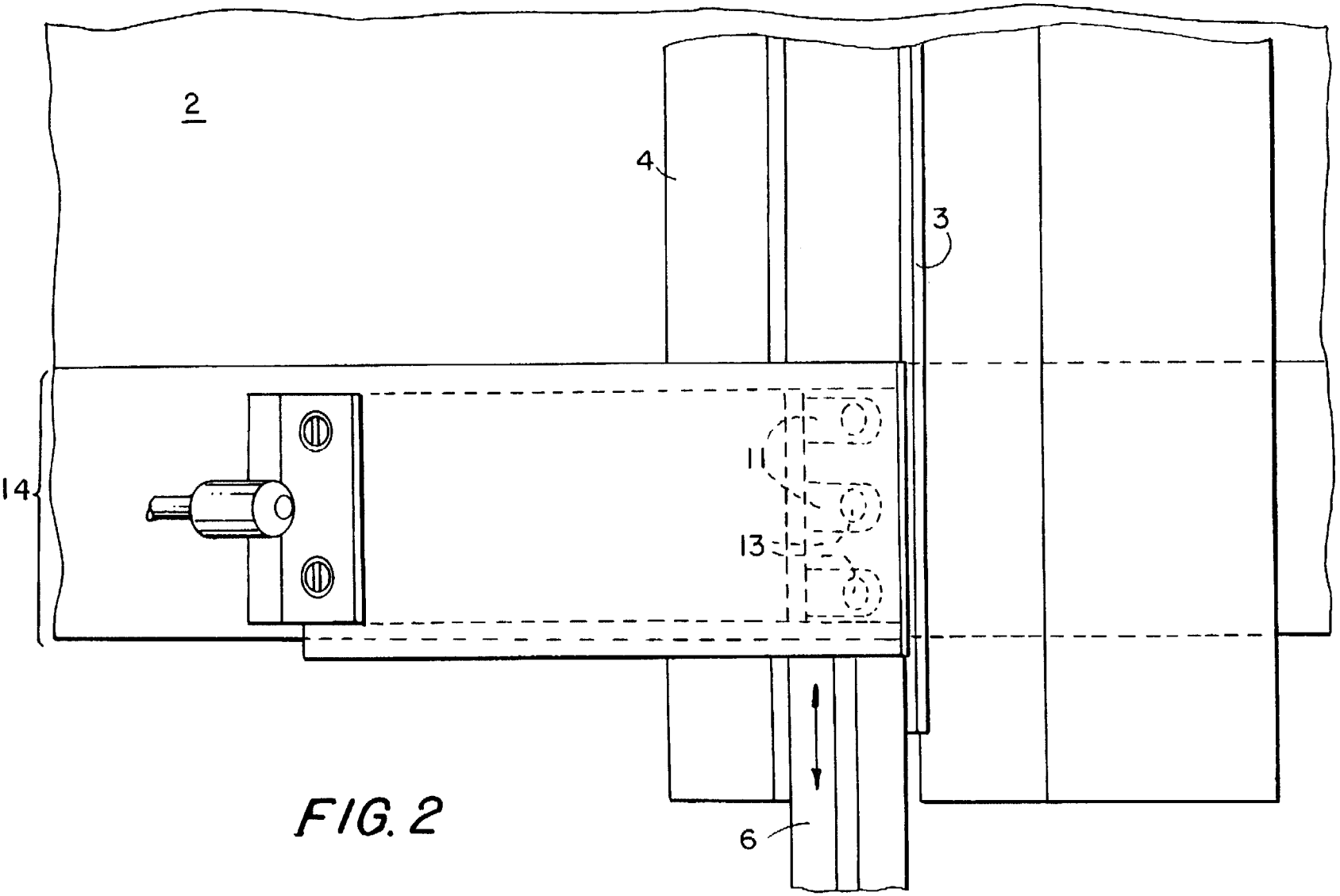
FIG. 2 shows a top view of the coating edge limiter located on the right in the coating arrangement.

According to FIG. 1, a formatting plate 8 almost completely covers an application zone 12 between the doctor blade element 3 and the barrier wall 4, so that an edge region 14 of the web 2 is sharply delineated and kept completely free of color, shown in FIG. 2. In each sealing block 5, there are three, or at least one, depression 11 in the form of a sink, which is open near the barrier wall 4 and ends before the doctor blade element 3. Each depression 11 extends parallel to the direction of movement of the paper web and is connected by a channel 13 to a centrally located water supply 20 in the sealing block 5. The water supplied through the channels 13 forms a pressure cushion in the depressions 11. The pressure cushion ensures that the formatting plate 8 is pressed against the web 2 and reliably prevents the color which is under pressure in the coating chamber, from emerging laterally through a narrow nip 15 having a width of approximately 1.5 mm, or between 1 mm and 3 mm. The water consumption of the coating edge limiter is approximately 2 to 5 liters per minute. Compared to coating throughput of up to 1,000 liters per minute, this is negligibly small, therefore no special measures for water drainage are necessary. The water flowing out laterally from the coating edge limiter is drained off together with the excess color. The formatting plate 8 is arranged on a formatting plate holder 7 in such a way as to extend over the barrier wall 4 into a space between the barrier wall 4 and the doctor blade element 3 in order to completely cover the application zone 12 in the edge region 14 of the web 2. A clamping device 19 is used to attach the formatting plate 8 to the formatting plate holder 7. The formatting plate holder 7 is connected permanently to the sealing block 5 and extends outwardly over the barrier wall 4 without touching the latter. On the free end of the formatting plate holder 7 is a water spraying device 9. A fine jet of water 16 is sprayed onto the formatting plate 8 at a pressure of approximately 0.5 bar to 1 bar through a needle nozzle 10 which has a diameter of about 0.5 mm.

With a sliding element 6, the coating edge limiter is arranged so as to be movable as a unit at a right angle to the direction of web movement.

I claim:

1. An apparatus for limiting a coating edge in a short dwell coater comprising:

a backing roll having a circumferential surface for guiding a web;

a doctor blade element abutting said backing roll and extending laterally across a width of the web;

a barrier wall oriented parallel to said doctor blade element, said barrier wall and said doctor blade element defining an application zone therebetween for applying coating to the web;

two means for limiting the coating edge, each of said edge limiting means comprising:

a sealing block interposed between said barrier wall and said doctor blade;

a sliding element operatively connected to said sealing block and interposed between said barrier wall and said doctor blade element;

each of said coating edge limiting means being arranged in an edge region of the web and movable in a direction perpendicular to a direction of movement of the web;

a formatting plate holder having a free end and an opposite end connected to said sealing block, said formatting plate holder extending outwardly over said barrier wall; and a thin formatting plate arranged on said formatting plate holder so as to extend over said barrier wall into a space between said barrier wall and said doctor blade element and to cover the application zone in the edge region of the web;

an upper surface of said sealing block facing said formatting plate having at least one depression extending parallel to the direction of movement of the web and connected to a water supply by a channel; said formatting plate and said sealing block defining therebetween a sealing gap having a width of between 1 mm and 3 mm, the water introduced into the sealing gap through the depression producing a pressure cushion and pressing said formatting plate flatly against the web.

2. The coating arrangement of claim 1, wherein said formatting plate is made of spring steel having a thickness of less than or equal to 0.4 mm and is attached to said formatting plate holder by a clamping device.

3. The coating arrangement of claim 2, wherein said formatting plate is movable in a direction perpendicular to the direction of movement of the web and overlaps in width with a width of said sealing block by approximately 5% to 20%.

4. The coating arrangement of claim 3, wherein said sealing block is made of metal.

5. The coating arrangement of claim 4, further comprising:

a water spraying device connected to the free end of said formatting plate holder, the water spraying device having a needle nozzle for spraying a jet of water onto said formatting plate.

* * * * *